US008882458B2

(12) United States Patent
Knoop et al.

(10) Patent No.: US 8,882,458 B2
(45) Date of Patent: Nov. 11, 2014

(54) COMPRESSOR AND METHOD FOR OPERATING A COMPRESSOR AND FUEL CELL DEVICE WITH A COMPRESSOR

(75) Inventors: Andreas Knoop, Esslingen (DE); Juergen Leitz, Dettingen (DE)

(73) Assignee: Daimler AG, Stuttgart (DE)

( * ) Notice: Subject to any disclaimer, the term of this patent is extended or adjusted under 35 U.S.C. 154(b) by 889 days.

(21) Appl. No.: 13/059,321

(22) PCT Filed: Aug. 4, 2009

(86) PCT No.: PCT/EP2009/005617

§ 371 (c)(1),
(2), (4) Date: Mar. 23, 2011

(87) PCT Pub. No.: WO2010/020341

PCT Pub. Date: Feb. 25, 2010

(65) Prior Publication Data

US 2011/0164974 A1 Jul. 7, 2011

(30) Foreign Application Priority Data

Aug. 18, 2008 (DE) ..... 10 2008 038 219
Oct. 2, 2008 (DE) ..... 10 2008 050 314

(51) Int. Cl.

| | |
|---|---|
| ***F01D 25/16*** | (2006.01) |
| ***F04D 25/04*** | (2006.01) |
| ***F04D 29/051*** | (2006.01) |
| ***F04D 29/058*** | (2006.01) |
| ***F04D 25/06*** | (2006.01) |
| ***F04D 29/02*** | (2006.01) |
| ***F04D 29/059*** | (2006.01) |

(52) U.S. Cl.

CPC ..... *F04D 25/04* (2013.01); *F04D 29/051* (2013.01); *F04D 29/058* (2013.01); *F04D 25/06* (2013.01); *F04D 29/023* (2013.01); *F04D 29/059* (2013.01)

USPC ..... 415/229

(58) Field of Classification Search

USPC ..... 415/104, 107, 142, 229; 417/407; 384/246; 310/90.5

See application file for complete search history.

(56) References Cited

U.S. PATENT DOCUMENTS 3,951,573 A 4/1976 Dunning et al.
5,605,045 A 2/1997 Halimi et al.

(Continued)

FOREIGN PATENT DOCUMENTS

EP 1 770 284 A2 4/2007
JP 61-185698 A 8/1986

(Continued)

OTHER PUBLICATIONS

Japanese Office Action Dated Jun. 5, 2013 {Four (4) Pages}.

(Continued)

*Primary Examiner* — Edward Look
*Assistant Examiner* — Maxime Adjagbe
(74) *Attorney, Agent, or Firm* — Crowell & Moring LLP

(57) ABSTRACT

A compressor with a housing having an air guide section and a bearing section, and a moving part having a compressor wheel and a shaft connected to the compressor wheel in a pivot-proof manner. The shaft is pivot-supported in the bearing section, and the compressor wheel is accommodated in a first chamber of the air guide section in a pivoting manner. The shaft is driveable by an electric motor and at least one radial bearing and one axial bearing are provided for supporting the shaft in the bearing section, wherein the axial bearing has at least one magnetic bearing. The axial bearing includes at least one first bearing and a second bearing, the first bearing configured in the region of the compressor wheel and the second bearing is configured in the region of an end of the moving part facing away from the compressor wheel.

18 Claims, 1 Drawing Sheet

(56) References Cited

U.S. PATENT DOCUMENTS

| | | | | |
|---|---|---|---|---|
| 5,657,956 | A * | 8/1997 | Smith et al. | 248/371 |
| 6,227,820 | B1 * | 5/2001 | Jarvik | 417/423.12 |
| 6,498,410 | B1 | 12/2002 | Yashiro et al. | |
| 6,846,167 | B2 | 1/2005 | Jaisle | |
| 2002/0196991 | A1 * | 12/2002 | Giesler et al. | 384/565 |
| 2007/0069597 | A1 * | 3/2007 | Taniguchi et al. | 310/90.5 |
| 2009/0025386 | A1 * | 1/2009 | Rumsby | 60/607 |
| 2009/0308690 | A1 * | 12/2009 | Jiang et al. | 184/5 |
| 2010/0111725 | A1 | 5/2010 | Knoop | |

FOREIGN PATENT DOCUMENTS

| | | | |
|---|---|---|---|
| JP | 62-111194 | A | 5/1987 |
| JP | 2000-240587 | A | 9/2000 |
| JP | 2001-263291 | A | 9/2001 |
| JP | 2003-336630 | A | 11/2003 |
| JP | 2004-92641 | A | 3/2004 |
| WO | WO 91/17361 | A1 | 11/1991 |
| WO | WO 98/28527 | A1 | 7/1998 |
| WO | WO 2006/039938 | A1 | 4/2006 |
| WO | WO 2008/086826 | A1 | 7/2008 |

OTHER PUBLICATIONS

International Search Report dated Nov. 11, 2009 with English Translation (eleven (11) degrees).

Form PCT/ISA/237 (ten (10) pages).

* cited by examiner

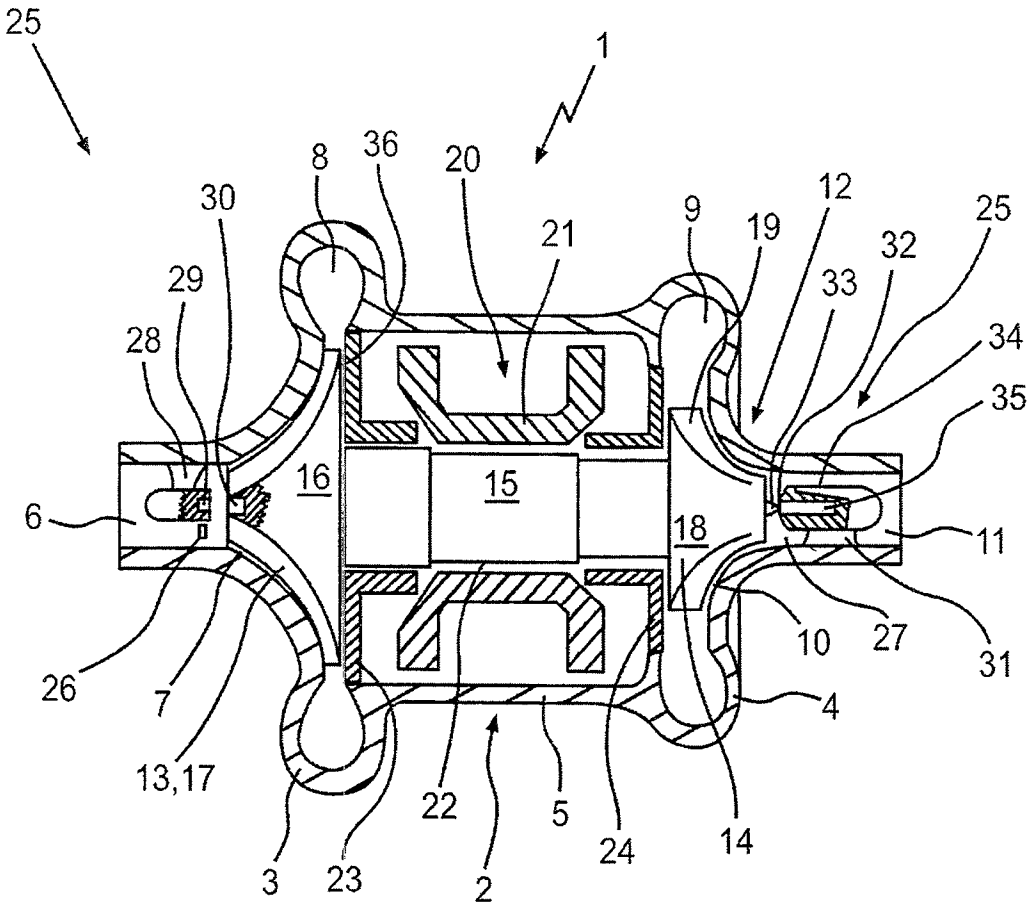
1
25
25
34
35
11
31
32
27
12
33
10
4
19
14
9
18
24
21
5
20
15
2
22
36
23
8
16
3
30
13,17
29
7
28
26
6

COMPRESSOR AND METHOD FOR OPERATING A COMPRESSOR AND FUEL CELL DEVICE WITH A COMPRESSOR

CROSS-REFERENCE TO RELATED APPLICATIONS

This application is a National Stage of PCT Application No. EP2009/005617, filed Aug. 4, 2009, and claims priority under 35 U.S.C. §119 to German Patent Application No. 10 2008 038 219.1, filed Aug. 18, 2008 and German Patent Application No. 10 2008 050 314.2, filed Oct. 2, 2008, the entire disclosures of the aforementioned documents are herein expressly incorporated by reference.

BACKGROUND AND SUMMARY OF THE INVENTION

Exemplary embodiments of the present invention relate to a compressor, a method for operating a compressor and a fuel cell device.

Fast-rotating work machines, in particular compressors, which are driven electrically, are equipped with ball bearings or with air bearings.

Conventional air bearings, in particular formed as foil air bearings or "Foil Air Bearing", in principle generate higher friction losses than ball bearings, wherein a large part of the losses is mainly generated by axial bearings.

U.S. Patent Application Publication No. US 2007/0069597 A1 discloses a compressor with a housing and a moving part, wherein the housing has an air guide section and a bearing section, and the moving part has a compressor wheel and a shaft connected to the compressor wheel in a pivot-proof manner. The shaft is mounted in a pivoted manner in the bearing section, and the compressor wheel is received in a first chamber in the air guide section in a pivoted manner. The shaft can be driven with the help of an electric motor. At least one radial bearing and an axial bearing are provided for the mounting of the shaft. The radial bearings are in the form of conventional air bearings. The axial bearing has magnetic bearings and air bearings. One problem with this arrangement is that magnets of the magnetic bearings are formed at rotatable sections of the magnetic bearing and do not have a secured fixing with the expected circumference speeds and high centrifugal forces.

Exemplary embodiments of the present invention reduce the friction losses generated during the operation of an electrically supported compressor while considering a secured operation.

According to one aspect of the invention, the axial bearing of the compressor comprises at least a first bearing and a second bearing, wherein the first bearing is formed in the region of the compressor wheel and the second bearing in the region of an end of the moving part facing away from the compressor wheel. A reduction of the friction losses is advantageously achieved by division of the axial bearing and the corresponding arrangement of the first bearing and the second bearing.

One bearing of the axial bearing can be a magnetic bearing and the other bearing of the axial bearing is a point bearing.

For increasing a drive performance of the compressor, a turbine is assigned to the compressor in such a manner that the housing additionally comprises an exhaust gas guide section and the moving part additionally a turbine wheel of the turbine, wherein the turbine wheel is received rotatably in a second chamber of the exhaust gas guide section and the turbine wheel is connected in a pivot-proof manner at an end of the shaft positioned facing away from the compressor wheel.

The magnetic bearing can comprise a holding device, which is formed in the entry channel near the compressor wheel.

The magnetic bearing can comprise at least two magnets, wherein a first magnet is fixed in the holding device and a second magnet in a hub of the compressor wheel at an end of the compressor wheel positioned facing the entry channel.

The magnetic bearing can comprise at least two magnets, which are arranged in such a manner that the same poles of the magnets are arranged facing each other.

The magnetic bearing can have at least two magnets, wherein at least one magnet is formed in the shape of a cylinder.

The point bearing comprises, in particular, a holding device positioned in the exit channel in the region of the turbine wheel.

The point bearing can comprise at least two balls, wherein a first ball is fixed in the holding device and a second ball in a hub of the turbine wheel at an end of the turbine wheel positioned facing the exit channel.

The point bearing can comprise two balls, which are formed of different materials.

In particular one ball, in particular the second ball, is formed of a hardened material, in particular steel, and the other ball, in particular the first ball, of a ceramic material.

At least one ball, in particular the first ball, of the point bearing can be moved axially, wherein the axial movement is ensured by a thread.

The axially movable ball can be fixed at a cylinder, which is received movably in the holding device of the point bearing by means of the thread.

At least one magnet, in particular the first magnet, can be formed in an annular manner. The other magnet, in particular the second magnet, can be arranged in the wheel back of the compressor wheel, so that the magnets repel.

The holding device of the magnetic bearing can be formed by a first radial bearing.

Both bearings of the axial bearing can be formed as magnetic bearing.

The shaft can be positioned axially contactless by the axial bearing, in particular in dependence on the design of the bearings, at least from a certain speed of the moving part.

The bearings can both be formed as magnetic bearings and the shaft is positioned permanently in a contactless manner.

The bearings of the axial bearing can be arranged on an axis. In particular, the magnets of the at least one magnetic bearing are arranged on this axis. Preferably, the magnets of the magnetic bearing and the balls of the point bearing are arranged on the axis with an arrangement of the axial bearing with a magnet and a point bearing.

With a method according to the invention for operating an exhaust gas turbocharger with a housing and a moving part, wherein the housing has an air guide section, an exhaust guide section and a bearing section, and the moving part a compressor wheel, a turbine wheel and a shaft connecting the compressor wheel with the turbine wheel in a pivot-proof manner, the shaft is mounted rotatably in the bearing section. The compressor wheel is received in a first chamber of the air guide section and the turbine wheel is received in a second chamber of the exhaust guide section in a rotatable manner, wherein the shaft is driven with the help of an electric motor, and for the mounting of the shaft in the bearing section, at least one radial bearing and an axial bearing is formed, wherein the axial bearing has at least one magnetic bearing.

The axial bearing comprises at least one first bearing and a second bearing, wherein the first bearing is formed in the region of the compressor wheel and the second bearing in the region of the turbine wheel.

In particular, with standstill and low speeds of the moving part, the first ball and the second ball of the point bearing of the axial bearing contact. From a certain speed of the moving part, from which air is taken in by the compressor wheel and is compressed, the charge pressure in a spiral channel is also formed at a wheel back of the compressor wheel. An axial force on the compressor wheel results thereby, wherein the compressor wheel and therewith the entire moving part is moved axially in the direction of the first entry channel. Due to this axial movement, the contact of the first ball and of the second ball is cancelled. With the help of the magnetic bearing and its magnets positioned in a repelling manner, a force balance results at the moving part with regard to the axial forces, so that the shaft of the moving part is positioned in an axially contactless manner and thus also in a frictionless manner.

A further aspect of the invention relates to a fuel cell device, in particular a mobile fuel cell device for use in a vehicle, in particular a motor vehicle, which comprises an exhaust gas turbocharger according to the invention or an advantageous embodiment thereof. The exhaust gas turbocharger is in particular used there for supplying oxidation means, such as oxygen of the oxygen-containing gas, to the fuel cell stack of the fuel cell device and/or for discharging the exhaust gas discharged by the fuel cell stack.

Advantageous embodiments of the exhaust gas turbocharger according to the invention are to be viewed as advantageous embodiments of the fuel cell device and as advantageous embodiments of the method according to the invention for operating the exhaust gas turbocharger.

BRIEF DESCRIPTION OF THE DRAWING FIGURE

Further advantages, characteristics and details of the invention result from the following description of an embodiment and by means of the only drawing, which illustrates an exhaust gas turbocharger with a compressor according to the invention.

DETAILED DESCRIPTION OF THE INVENTION

The only FIGURE shows an exhaust gas turbocharger 1 with a compressor according to the invention, which is preferably used in a fuel cell system. The exhaust gas turbocharger 1 has a housing 2 with an air guide section 3, and exhaust gas guide section 4 and a bearing section 5. The air guide section 3 has a first entry channel 6, a first chamber 7 downstream of the entry channel 6, a first spiral channel 8 arranged downstream of the first chamber 7 and an exit channel not shown in detail arranged downstream of the first spiral channel 8. The exhaust guide section 4 has a first exit channel not shown in detail. The exhaust guide section 4 has a second entry channel not shown in detail, with the help of which exhaust gas is guided into a second spiral channel 9 downstream of the first entry channel 6. Downstream of the second spiral channel 9 is formed a second chamber 10 in the exhaust guide section 4, to which is assigned a second exit channel 11 of the exhaust gas guide section 4 downstream.

Housing 2 receives a moving part 12 of the exhaust gas turbocharger 1 in a rotatable manner, wherein the moving part 12 comprises a compressor wheel 13, a turbine wheel 14 and a shaft 15 connecting the compressor wheel 13 to the turbine wheel 14 in a pivot-proof manner. The shaft 15 is mounted rotatably in the bearing section 5. The compressor wheel 13 is received in the first chamber 7 of the air guide section 3 and the turbine wheel 14 is received rotatably in the second chamber 10 of the exhaust gas guide section 4. The compressor wheel 13 has a first hub 16 and a plurality of compressor wheel blades 17 arranged on the first hub 16. The turbine wheel 14 has a second hub 18 and a plurality of turbine wheel blades 19 arranged on the second hub 18.

For supporting a rotational movement and/or for initiating the rotational movement of the moving part 12, an electric motor 20 is arranged in the bearing section, which comprises a stator 21 and a rotor 22. The rotor 22 is formed as part of the rotating shaft 15.

For mounting the shaft 15, a first radial bearing 23 is arranged in the bearing section 5 in the region of an end of the shaft 15 positioned facing the first chamber 7, and a second radial bearing 24 in the region of an end of the shaft 15 positioned facing the second chamber 10 for receiving radial forces. The first radial bearing 23 and the second radial bearing 24 are formed in the form of a film-coated air bearing corresponding to the state of the art.

For receiving axial forces, an axial bearing 25 is arranged, which comprises a magnetic bearing 26 and a point bearing 27. The magnetic bearing 26 is positioned in the region of the compressor wheel 13, the point bearing 27 is arranged in the region of the turbine wheel 14.

The magnetic bearing 26 comprises a first holding device 28, a first magnet 29 and a second magnet 30. The first holding device 28 is formed in the first entry channel 6 near the compressor wheel 13. The first magnet 29 is fixed in the first holding device 28. The second magnet 30 is fixed in the first hub 16 of the compressor wheel 13 at an end of the compressor wheel 13 positioned facing the first entry channel 6. Ideally, the first magnet 29 and the second magnet 30 are formed in the shape of a cylinder. The first magnet 29 and the second magnet 30 are arranged in the holding device 28 or in the first hub 16 in such a manner that the same poles of the magnets 29, 30 are arranged opposite each other in such a manner that the magnets 29, 30 have a repelling force with regard to each other.

The point bearing 27 comprises a second holding device 31, a first ball 32 and a second ball 33. The second holding device 31 is positioned in the second exit channel 11 in the region of the turbine wheel 14. The first ball 32 is arranged axially movable in the second holding device 31. The second ball 33 is fixed in the second hub 18 of the turbine wheel 14 at an end of the turbine wheel 14 positioned facing the second exit channel 11. The second ball 33 is hardened, and can be, for example, manufactured of steel. The first ball 32 has a ceramic material, wherein the first ball 32 can also be formed of another material having a high hardness value.

The axial movement of the first ball 32 takes place in this embodiment with the help of a thread 34. The first ball 32 is thereby fixed to a cylinder 35, which is movably received in the second holding device 31 with the help of the thread 31.

During standstill and with low speeds of the moving part 12, the first ball 32 and the second ball 33 contact each other. From a certain speed of the moving part 12, where air is taken in by the compressor 13 and is compressed, the charge pressure present in the first spiral channel 8 is also formed at a wheel back 36 of the compressor wheel 13. An axial force on the compressor wheel 13 results thereby, wherein the compressor wheel 13 and therewith the entire moving part 12 is moved axially in the direction towards the first entry channel. Due to this axial movement, the contact of the first ball 32 and of the second ball is cancelled. With the help of the magnetic bearing 26 and its magnets 29, 30 positioned in a repelling manner, a force balance results at the moving part 12 with regard to the axial forces, so that the shaft 15 of the moving part 12 is positioned axially contactless and therewith also frictionless.

In a further embodiment, not shown in detail, the point bearing 27 is formed as a magnetic bearing. The shaft 15 is thus mounted axially contactless and thereby frictionless even during standstill and with low speeds.

As the surface of the two magnets 29, 30 is approximately proportional to the repelling force, the first magnet 29 could also be designed in the form of a ring in an embodiment not shown in detail, wherein the first radial bearing 23 is used as holding device 28. The second magnet 30 then has to be arranged in the wheel back 36 of the compressor wheel 13 in such a manner that a repelling of the first magnet 29 and of the second magnet 30 is ensured.

Placing the first magnet 29 and of the second magnet 30 into a correspondingly formed disk would also be possible.

It can be seen in the FIGURE that the magnets 28, 30 of the magnetic bearing 26 and the balls 32 and 33 of the point bearing 27 are arranged on the axis of the exhaust gas turbocharger, wherein the axis is shown schematically through the horizontal central line.

The depiction of the only FIGURE is exemplary and only shows one embodiment of the compressor according to the invention. In an embodiment not shown in detail, the second bearing 27 is arranged at an end of the shaft positioned facing the compressor wheel, as the compressor is here only operated with the help of the electric motor 20 and the exhaust gas guide section 4 and the turbine wheel are omitted. The principal construction of the second bearing 27 corresponds to the above-described construction.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

The invention claimed is:

1. A compressor, comprising:

a housing with an air guide section and a bearing section; and a moving part with a compressor wheel and a shaft connected to the compressor wheel in a pivot-proof manner, wherein the shaft is pivot-supported in the bearing section, and the compressor wheel is accommodated in a first chamber of the air guide section in a pivoting manner, wherein the shaft is driveable by an electric motor, wherein at least one radial bearing and one axial bearing are arranged to support the shaft in the bearing section, wherein the axial bearing comprises at least one first magnetic bearing and a second bearing, wherein the at least one first magnetic bearing is arranged in a region of the compressor wheel and the second bearing is arranged in a region of an end of the moving part facing away from the compressor wheel and the compressor is a radial compressor, wherein the shaft is arranged to rotate about an axis and the at least one first magnetic bearing and the second bearing are arranged on the axis, wherein the at least one first magnetic bearing comprises a holding device arranged in an entry channel near the compressor wheel, wherein the at least one first magnetic bearing comprises at least two magnets, wherein a first magnet is fixed in a the holding device and a second magnet in a hub of the compressor wheel at an end of the compressor positioned facing the entry channel.

2. The compressor according to claim 1, wherein a turbine is assigned to the compressor in such a manner that the housing additionally comprises an exhaust gas guide section and the moving part additionally comprises a turbine wheel of the turbine, wherein the turbine wheel is arranged in a second chamber of the exhaust gas guide section in a pivoting manner and the turbine wheel is connected to the shaft in a pivot-proof manner at an end of the shaft positioned away from the compressor wheel.

3. The compressor according to claim 1, wherein the holding device of the at least one magnetic bearing is formed by a first radial bearing.

4. The compressor according to claim 1, wherein the at least two magnets of the at one first magnetic bearing are arranged in such a manner that the same poles of the magnets are arranged to face each other.

5. The compressor according to claim 1, wherein at least one magnet of the at least one first magnetic bearing has a cylinder shape.

6. The compressor according to claim 4, wherein the first magnet of the at least one first magnetic bearing has an annular form.

7. The compressor according to claim 4, wherein the second magnet of the at least one first magnetic bearing is arranged in the wheel back of the compressor wheel so that the two magnets repel each other.

8. A compressor, comprising:

a housing with an air guide section and a bearing section; and a moving part with a compressor wheel and a shaft connected to the compressor wheel in a pivot-proof manner, wherein the shaft is pivot-supported in the bearing section, and the compressor wheel is accommodated in a first chamber of the air guide section in a pivoting manner, wherein the shaft is driveable by an electric motor, wherein at least one radial bearing and one axial bearing are arranged to support the shaft in the bearing section, wherein the axial bearing comprises at least one first magnetic bearing and a second bearing, wherein the first bearing is arranged in a region of the compressor wheel and the second bearing is arranged in a region of an end of the moving part facing away from the compressor wheel and the compressor is a radial compressor, wherein a turbine is assigned to the compressor in such a manner that the housing additionally comprises an exhaust gas guide section and the moving part additionally comprises a turbine wheel of the turbine, wherein the turbine wheel is arranged in a second chamber of the exhaust gas guide section in a pivoting manner and the turbine wheel is connected to the shaft in a pivot-proof manner at an end of the shaft positioned away from the compressor wheel, wherein the second bearing of the axial bearing is a point bearing.

9. The compressor according to claim 8, wherein the point bearing comprises a holding device positioned in an exit channel in a region of the turbine wheel.

10. The compressor according to claim 8, wherein the point bearing comprises at least two balls, wherein a first ball is fixed in a holding device and a second ball is in a hub of the turbine wheel at an end of the turbine wheel positioned facing the exit channel.

11. The compressor according to claim 8, wherein the point bearing comprises two balls comprised of different materials.

12. The compressor according to claim 11, wherein the second ball is steel, and the first ball is a ceramic material.

13. The compressor according to claim 10, wherein the first ball of the point bearing is axially moveable and the axial movement is ensured by a thread.

14. The compressor according to claim 13, wherein the axially movable ball is fixed to a cylinder, which is received in the holding device of the point bearing in a movable manner by the thread.

15. The compressor according to claim 1, wherein the second bearing of the axial bearing is a magnetic bearing.

16. The compressor according to claim 1, wherein the shaft is positioned in an axially contactless manner by the axial bearing at least from a certain speed of the moving part.

17. The compressor according to claim 16, wherein the second bearing of the axial bearing is a magnetic bearing and the shaft is permanently positioned in contactless manner.

18. A fuel cell device for a vehicle, the fuel cell device comprising:

a compressor, the compressor comprising a housing with an air guide section and a bearing section; and a moving part with a compressor wheel and a shaft connected to the compressor wheel in a pivot-proof manner, wherein the shaft is pivot-supported in the bearing section, and the compressor wheel is accommodated in a first chamber of the air guide section in a pivoting manner, wherein the shaft is driveable by an electric motor, wherein at least one radial bearing and one axial bearing are arranged to support the shaft in the bearing section, wherein the axial bearing comprises at least one first magnetic bearing and a second bearing, wherein the at least one first magnetic bearing is arranged in a region of the compressor wheel and the second bearing is arranged in a region of an end of the moving part facing away from the compressor wheel and the compressor is a radial compressor, wherein the shaft is arranged to rotate about an axis and the at least one first magnetic bearing and the second bearing are arranged on the axis, wherein the at least one first magnetic bearing comprises a holding device arranged in an entry channel near the compressor wheel, wherein the at least one first magnetic bearing comprises at least two magnets, wherein a first magnet is fixed in a the holding device and a second magnet in a hub of the compressor wheel at an end of the compressor positioned facing the entry channel.

* * * * *